US009797131B1

(12) United States Patent
Battaglia

(10) Patent No.: US 9,797,131 B1
(45) Date of Patent: Oct. 24, 2017

(54) MULLION SEAL

(71) Applicant: STC Architectural Products, LLC, Buffalo, NY (US)

(72) Inventor: Paul L. Battaglia, Amherst, NY (US)

(73) Assignee: STC Architectural Products, LLC, Buffalo, NY (US)

( * ) Notice: Subject to any disclaimer, the term of this patent is extended or adjusted under 35 U.S.C. 154(b) by 0 days.

(21) Appl. No.: 15/264,878

(22) Filed: Sep. 14, 2016

(51) Int. Cl.

| | |
|---|---|
| ***E04B 2/96*** | (2006.01) |
| ***E04B 1/84*** | (2006.01) |
| *E04B 1/82* | (2006.01) |
| *E04F 19/02* | (2006.01) |

(52) U.S. Cl.
CPC . *E04B 1/84* (2013.01); *E04B 2/96*(2013.01); *E04B 2001/8263* (2013.01); *E04F 19/022* (2013.01)

(58) Field of Classification Search
CPC ..... E04B 2/96; E04B 1/6812; E04B 2/7409; E04B 1/84; E04F 19/02; E06B 2003/6244
See application file for complete search history.

(56) References Cited

U.S. PATENT DOCUMENTS 4,691,489 A * 9/1987 Shea, Jr. ..... E06B 3/5427 52/204.593
4,703,598 A * 11/1987 Wilson ..... E04B 2/7409 52/204.591
4,798,035 A * 1/1989 Mitchell ..... E04B 2/7409 52/242
4,803,820 A 2/1989 Metrick
5,076,035 A * 12/1991 Wright ..... E04B 2/96 52/464
5,300,171 A 4/1994 Braun et al.
(Continued)

FOREIGN PATENT DOCUMENTS

DE 10255598 A1 7/2003
DE 102004012473 A1 10/2005
(Continued)

OTHER PUBLICATIONS

Anonymous, "Emseal Expansion Joints and Pre-Compressed Sealants", Emseal Joint Systems Ltd., May 2016, 3 pages.
(Continued)

*Primary Examiner* — Brian Glessner
*Assistant Examiner* — Daniel Kenny
(74) *Attorney, Agent, or Firm* — Walter W. Duft

(57) ABSTRACT

An acoustic seal for a sound flanking path between an interior architectural separation and a mullion. A seal body is configured as an elongated rail having a base rail portion and a side rail portion. The base rail portion has sides defining a first seal surface for engaging a first interior side of the mullion, and a second seal surface for engaging an end wall of the architectural separation. The side rail portion has sides defining a third seal surface substantially non-parallel with respect to the first seal surface for engaging a second interior side of the mullion, and a fourth seal surface in substantially coplanar relationship with the second seal surface for engaging the end wall of the architectural separation. The first and third seal surfaces may form an inside seal corner for enveloping an outside corner of the mullion defined by the mullion's first and second interior sides.

21 Claims, 3 Drawing Sheets

(56) References Cited

U.S. PATENT DOCUMENTS

| | | | | |
|---|---|---|---|---|
| 6,351,915 | B1 * | 3/2002 | Puckett | E04B 2/82 52/167.1 |
| 8,541,084 | B2 | 9/2013 | Deiss et al. | |
| 8,572,914 | B2 * | 11/2013 | Burgess | E04B 2/90 52/144 |
| 8,997,414 | B2 * | 4/2015 | Fletcher | F16J 15/14 52/255 |
| 2006/0137262 | A1 | 6/2006 | Crowder-Moore et al. | |
| 2007/0125011 | A1 * | 6/2007 | Weir | E04B 2/7409 52/144 |
| 2007/0193126 | A1 | 8/2007 | Teodorovich | |
| 2008/0141597 | A1 | 6/2008 | O'Rourke et al. | |

FOREIGN PATENT DOCUMENTS

| | | | |
|---|---|---|---|
| DE | 202005004044 | A1 | 7/2006 |
| EP | 1992776 | A2 | 11/2008 |
| EP | 2089595 | B1 | 8/2012 |

OTHER PUBLICATIONS

Anonymous, "Mull It Over", Mull It Over Products, Aug. 2012, 1 page.

* cited by examiner

MULLION SEAL

BACKGROUND

1. Field

The present disclosure relates to sound suppression and acoustical privacy in architectural structures. More particularly, the disclosure is directed to noise attenuation in flanking paths between the ends of interior separations and mullions in curtain wall and storefront constructions.

2. Description of the Prior Art

By way of background, commercial building codes typically impose acoustic privacy restrictions that limit the amount of noise permitted to pass through interior separations. For example, section 1207.2 of the International Building Code (IBC) imposes the following requirement for air-borne sound:

"Walls, partitions and floor/ceiling assemblies separating dwelling units from each other or from public or service areas shall have a sound transmission class (STC) of not less than 50 (45 if field tested) for air-borne noise when tested in accordance with ASTM E 90."

In curtain wall and storefront constructions, unsealed interfaces between the ends of interior separations and the exterior mullions produce "flanking paths" for air-borne sound that may severely compromise the transmission loss intended for the separation. The sound that invades through such flanking paths compromises the acoustic integrity of the separations irrespective of the acoustic attenuation qualities of the separation structures themselves. Applicant submits that this issue needs to be addressed if adequate levels of privacy and confidentiality are to be attained.

SUMMARY

In a first aspect, an acoustic seal is provided for sealing a sound flanking path between an interior architectural separation and a mullion.

In an embodiment, the acoustic seal may include a seal body configured as an elongated rail having a base rail portion and a side rail portion.

In an embodiment, the base rail portion may have two substantially planar and mutually parallel base rail sides, one defining a first seal surface arranged to engage a first interior side of the mullion, the other defining a second seal surface arranged to engage an end wall of the interior architectural separation.

In an embodiment, the side rail portion may have two substantially planar and mutually non-parallel side rail sides, one defining a third seal surface that is substantially non-parallel with respect to the first seal surface and arranged to engage a second interior side of the mullion, the other defining a fourth seal surface that is in substantially coplanar relationship with the second seal surface and arranged to engage the end wall of the interior architectural separation.

In an embodiment, the first seal surface and the third seal surface may form an inside seal corner that is arranged to envelop an outside corner of the mullion defined by the first and second interior sides of the mullion.

In a second aspect of the disclosure, an architectural assembly may include an interior architectural separation, a mullion, and an acoustic seal as summarized above sealing a sound flanking path between the interior architectural separation and the mullion.

In a third aspect of the disclosure, an architectural assembly construction method may include providing an acoustic seal as summarized above for sealing a sound flanking path between an interior architectural separation and a mullion.

The acoustic seal may be mounted on the mullion with the first sealing surface facing the first interior side of the mullion and the third sealing surface facing the second interior side of the mullion. An end wall of an interior architectural separation may be mounted to the acoustic seal with the end wall facing the first and fourth sealing surfaces of the acoustic seal.

BRIEF DESCRIPTION OF THE DRAWINGS

The foregoing and other features and advantages will be apparent from the following more particular description of example embodiments, as illustrated in the accompanying Drawings, in which.

DETAILED DESCRIPTION OF EXAMPLE EMBODIMENTS

Figure 1:
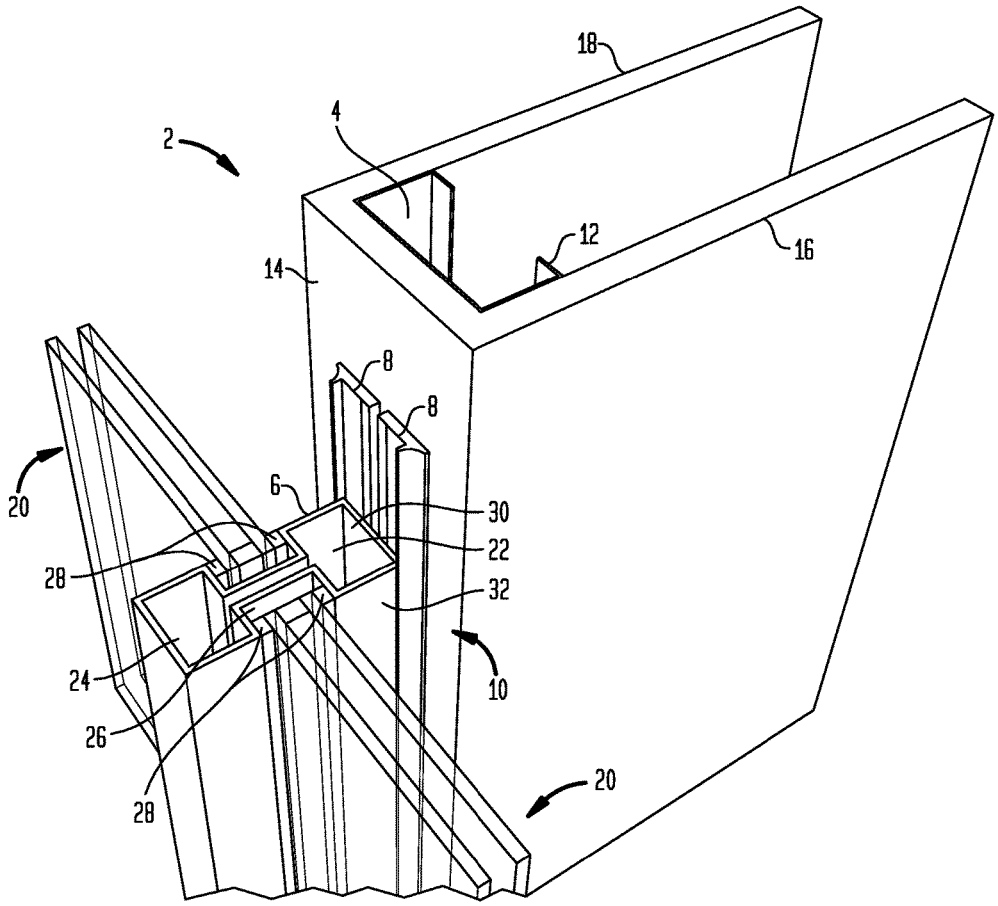
FIG. 1 is a fragmentary perspective view showing an example architectural assembly having an interior architectural separation, a curtain wall or storefront mullion, and an acoustic seal arrangement sealing a sound flanking path between an end of the architectural separation and an interior face of the mullion.

Turning now to the drawing figures, which are not necessarily to scale, like reference numbers are used to indicate like structure in all of the several views. FIG. 1 illustrates an architectural assembly 2 constructed in accordance with an example embodiment of the present disclosure. In the illustrated embodiment, the assembly 2 includes an interior architectural separation 4, a curtain wall or storefront mullion 6, and a pair of acoustic seals 8 for sealing a sound flanking path 10 between the interior architectural separation and the mullion.

The architectural separation 4 may be of any suitable construction. In the illustrated embodiment, the architectural separation 4 is a metal frame vertical wall structure onto which sheets of drywall (a.k.a, gypsum board, wallboard, plasterboard) are mounted. In FIG. 1, only one end of the architectural separation 4 is shown, namely, the end that faces the mullion 6. At this end of the architectural separation 4, a vertical end stud 12 supports a narrow drywall sheet that defines an interior end wall 14 of the architectural separation. The end stud 12 additionally supports two drywall sheets that define respective first and second sidewalls 16 and 18 of the architectural separation. For ease of description, other structural elements that may be present in the architectural separation 4, such as additional wall studs, top and bottom plates, etc., are omitted from FIG. 1.

The mullion 6 may be of any suitable construction. In the illustrated embodiment, the mullion 6 is a frame structure, made from metal or other suitable material, that supports the opposing ends of a pair of glass sheet assemblies 20. The mullion 6 may include an interior member 22, an exterior member 24 and an intermediate member 26. Seal members 28 may be used to seal the ends of the glass sheet assemblies 20 to the mullion 6.

Of interest to the present discussion is the mullion's interior member 22, which may be of any suitable shape and construction. FIG. 1 illustrates one possible design in which the interior member 22 is of generally rectangular or similar shape, and may have either a tube-like (as shown) or solid construction. In the illustrated embodiment, the mullion interior member 22 defines a first interior side 30 of the mullion that opposes the end wall 10 of the architectural separation 4. The mullion interior member 22 also defines a pair of second interior sides 32 that extend from the edges of the first interior side 30, away from the end wall 14 of the architectural separation 4. The angles between the first interior side 30 and the second interior interior sides 32 are shown in FIG. 1 as being approximately 90 degrees (perpendicular). However, this is for purposes of illustration only, and it will be appreciated that other angles may be used.

Figure 2:
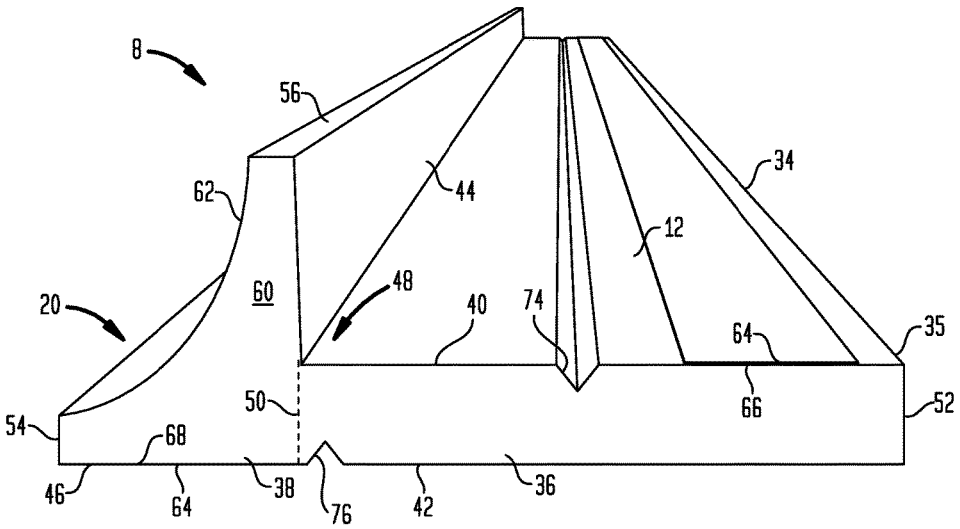
FIG. 2 is a top perspective view of an acoustic seal that may be used in the architectural assembly of FIG. 1.
Figure 3:
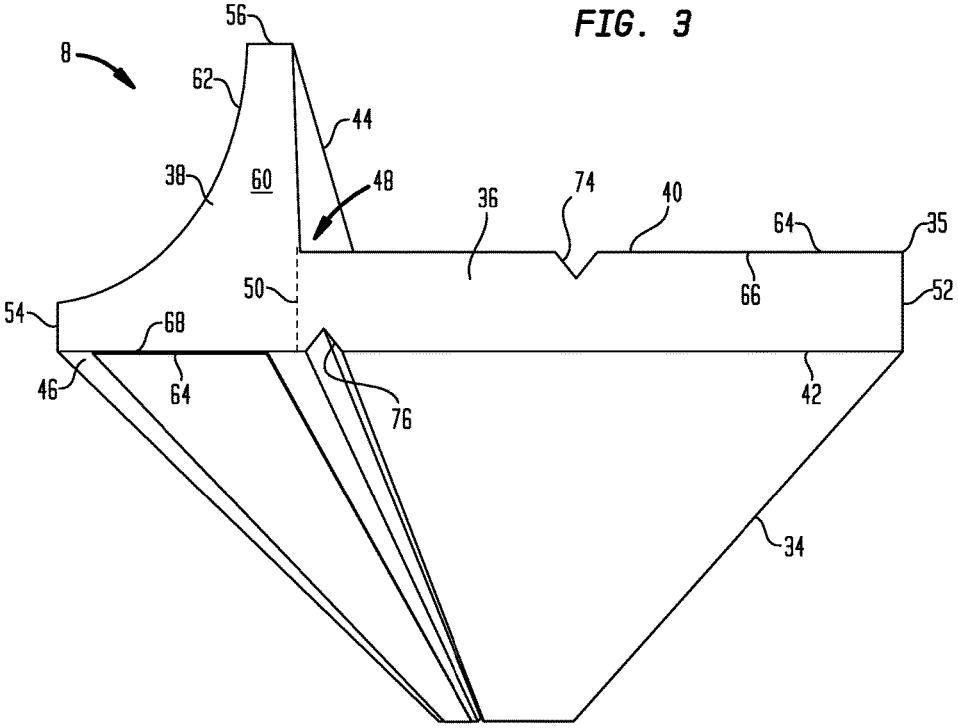
FIG. 3 is a bottom perspective view of the acoustic seal of FIG. 2.

With additional reference now to FIGS. 2 and 3, each acoustic seal 8 may include a seal body 34 that may be formed entirely from an elastomeric acoustic isolating material. Example materials include, but are not limited to, solid neoprene rubber having sufficient flexibility to allow the acoustic seal 8 to flex in the manner to be described below in connection with FIGS. 4 and 5. The acoustic seals 8 may be produced in a variety of colors, including but not limited to white, black, aluminum gray, etc.

The seal body 34 may be configured as an elongated rail 35 that may be extruded, molded or otherwise formed. The elongated length of the seal body 34 is a matter of design choice, but it may be advantageous to form the seal body into long lengths that can be wound into rolls and field-cut or trimmed to size at a construction job site to the actual lengths required. Alternatively, the seal body 34 could be produced in lengths that are compatible with a standard architectural floor-to-ceiling dimension, such as 8 ft., 10 ft., 12 ft., etc. For example, the seal body 34 could be any of the foregoing lengths, a multiple of such lengths, or a fraction of such lengths. It will be appreciated that if the seal body 34 is longer than the length needed for the architectural assembly 2, the seal body may be field-cut as needed. Similarly, if the seal body 34 is shorter than the length need for the architectural assembly 2, two or more acoustic seals 8 may be combined in a single run of such seals. However, care should be taken to avoid gaps between adjacent seals so as not to compromise acoustic isolation integrity.

The seal body 34 may include a base rail portion 36 and a side rail portion 38. The base rail portion 36 may have two substantially planar and mutually parallel base rail sides, one defining a first seal surface 40 arranged to engage the first interior side 30 of the mullion 6, the other defining a second seal surface 42 arranged to engage the end wall 10 of the architectural separation 4.

The side rail portion 38 may have two substantially planar and mutually non-parallel side rail sides, one defining a third seal surface 44 that is substantially non-parallel (e.g., perpendicular) to the first seal surface 40 and arranged to engage one of the second interior sides 32 of the mullion 6, the other defining a fourth seal surface 46 that is in substantially coplanar relationship with the second seal surface 42 and arranged to engage the end wall 10 of the architectural separation 4.

The first seal surface 40 and the third seal surface 44 may form an inside corner 48 of the acoustic seal 8 that is arranged to envelop an outside corner of the mullion 6 defined by the first interior side 30 of the mullion and one of its second interior sides 32. The angle of the inside corner 48 may be selected to correspond to the angle between the first and second interior sides 30 and 32 of the mullion 6, thereby providing a tight fit with good acoustic isolation properties. In the illustrated embodiment, the inside corner 48 is lies at the intersection of the first and third seal surfaces 40 and 44 at a laterally interior region 50 of the seal body 34. The laterally interior region 50 may be thought of as the location at which the base rail portion 36 meets and merges with the side rail 38, it being understood that both rail portions may be formed as part of a common integral structure. It will be appreciated that the configuration of the inside corner 48 may be square, filleted, (e.g., with a chamfer or radius) or otherwise defined to accommodate the outside corner profile of the mullion 6.

The base rail portion 36 may have a base rail free edge 52 that defines a first longitudinal edge of the elongated rail 35. The first and second seal surfaces 40 and 42 may extend from the laterally interior region 50 of the seal body 34 to the first base rail free edge 52. The side rail portion 38 may have a first side rail free edge 54 that defines a second longitudinal edge of the elongated rail 35. The fourth seal surface 46 may extend from the laterally interior region 50 of the seal body 34 to the first side rail free edge 54. The third seal surface 44 may extend from the inside seal corner 48 to a second side rail free edge 56 that defines a longitudinal edge of a flange portion 60 of the elongated rail 35.

If desired, the side rail portion 38 may be configured to have an angled surface 62 extending between the first and second side rail free edges 54 and 56, such that the side rail portion functions as an architectural molding. In the illustrated embodiment, the angled surface 62 is curved, with the curvature being concave so as to provide a cove molding configuration. In other embodiments, the angled surface could be formed with a convex curvature so as to provide a round molding configuration. Other configurations could also be used.

As can be seen in FIGS. 2 and 3, adhesive 64 may be disposed on respective first and second adhesive-bearing portions 66 and 68 of the first seal surface 40 and the fourth seal surface 46. The adhesive 64 may be provided in the form of double-sided adhesive strips (e.g., with peel-off backing layers), or in any other suitable manner. The first and second adhesive-bearing portions 66 and 68 are laterally offset from each another. This provides an advantageous feature of the acoustic seal 8 that accommodates relative movement between the interior architectural separation 4 and the mullion 6 that produces changes in spacing between the end wall 14 of the interior architectural separation and the first interior side 30 of the mullion.

Figure 4:
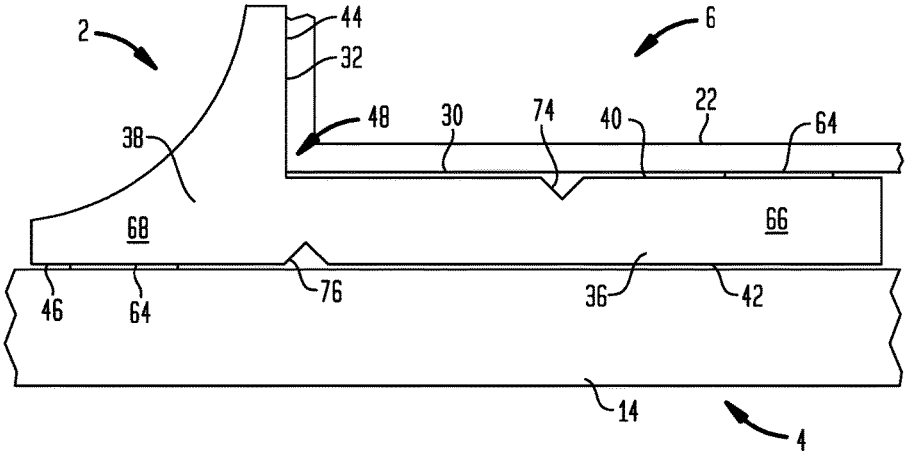
FIG. 4 is a fragmentary end view of the architectural assembly of FIG. 1.
Figure 5:
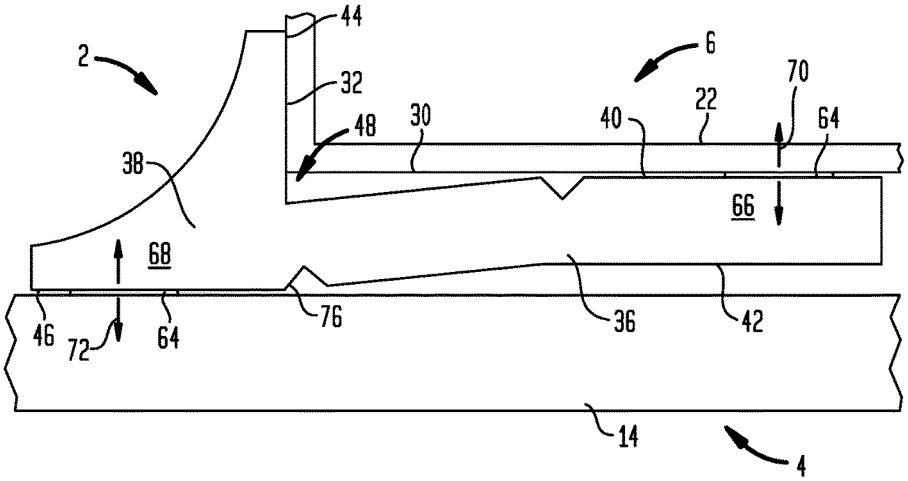
FIG. 5 is a fragmentary end view according to FIG. 4, and showing flexing of the acoustic seal of the architectural assembly due to relative movement between the architectural separation and the mullion.

FIGS. 4 and 5 are illustrative. In FIG. 4, the architectural assembly 2 is shown in a default state in which the end wall 14 of the architectural separation 4 and the first interior side 30 of the mullion 6 have a nominal spacing. This will likely be the spacing that exists when the acoustic seals 8 are initially installed in the architectural assembly 2. In FIG. 5, the architectural assembly 2 is shown in a deflected state following relative movement between the architectural separation 4 and the mullion 6 that increases the spacing between the end wall 14 of the architectural separation and the first interior side 30 of the mullion. This relative movement could be due to several factors, such as expansion, contraction, deflection or drift of the mullion 6.

It will be seen in FIG. 5 that the acoustic seal 8 is capable of undergoing offset flexing that allows the base rail portion 36 to displace relative to the side rail section 38. Due to the adhesive 64, the first seal surface 40 remains attached to and travels with the first interior side 30 of the mullion 6, and the fourth seal surface 46 remains attached to and travels with the end wall 14 of the architectural separation 4. The arrows 70 and 72 illustrate the applied loads that develop on the adhesive 64 as the architectural separation 4 and the mullion 6 move away from each other. The relatively low elastic modulus of the acoustic seal material allows the seal to undergo offset flexing without undue resistance.

To further facilitate offset flexing of the base rail portion 36 and the side rail portion 38, a pair of first and second channels 74 and 76 may be provided in the acoustic seal 8. The first channel 74 may be formed in the first seal surface 40 between the first adhesive-bearing portion 66 and the interior corner 52. The second channel 76 may be formed in the second seal surface 42 proximate to the laterally interior region 50 representing the area of intersection between the second seal surface and the fourth seal surface 46. The first and second channels 74 and 76 may be configured in any suitable manner that facilitate the offset flexing. For example, in the illustrated embodiment, the first and second channels 70 and 72 are configured as V-shaped notches. Other channel configurations could also be used.

An advantage of constructing the acoustic seal 8 to undergo offset flexing is that the architectural separation 4 and the mullion 6 are allowed to move apart without the applied loads 70 and 72 on the adhesive 64 becoming excessive. Due to the elastic modulus of the acoustic seal material, the offset distance between the adhesive-bearing portions 66 and 68, and the flexibility-enhancing properties of the channels 74 and 76, the applied loads 70 and 72 remain relatively low. In contrast, if the adhesive-bearing portions 66 and 68 were not laterally offset, and instead were laterally aligned, any structural movement tending to increase the spacing between the architectural separation 4 and the mullion 6 would quickly produce large applied loads on the adhesive that would likely result in adhesive failure.

Returning now to FIG. 1, the architectural assembly 2 may be constructed according an example method now to be described. According to this method, a pair of the acoustic seals 8 may be provided, such as by bringing or delivering the seals to the construction job site. If necessary, the acoustic seals 8 may be cut or trimmed to length and pre-fit on both interior corners of the mullion interior member 22. The side rail portion 38 of the seal body 34 may be trimmed away (e.g., at the laterally intermediate region 50) at the head, sill and intermediate horizontal mullions (if present) of the curtain or storefront wall, to provide a tight fit. The acoustic seals 8 may be mounted on the mullion 8 with the first sealing surface 40 of each seal facing the first interior side 30 of the mullion and the third sealing surface 44 facing one of the mullion's second interior sides 32. The acoustic seals 8 may secured to the mullion 6 using the adhesive 64 located at the adhesive-bearing location 66.

If the adhesive 64 at the adhesive-bearing location 66 is in the form of an adhesive strip, one side may already be adhered to the acoustic seals 8, and the seals may be attached to the mullion 6 by removing a peel-off backing (if present) from the other side of the adhesive strip prior to pressing the seals onto the mullion. Alternatively, if an adhesive strip is not already attached to the acoustic seals 8 at the adhesive-bearing location 66, a pair of adhesive strips could first be applied to either the seals or the mullion 6, and the seals could then be pressed onto the mullion. Once the acoustic seals 8 are in place, the end wall of the architectural separation 4 may be mounted to the seals, with the end wall 14 thereof facing the first and fourth sealing surfaces 40 and 46 of the seals.

One way to construct the architectural separation 4 is to form an assembly consisting of the drywall piece that forms the end wall 14 and the end stud 12. Before attaching this assembly to the top and bottom plates of the architectural separation, the assembly may be mounted to the acoustic seals 8, with the end wall 14 facing the second and fourth sealing surfaces 42 and 46. The acoustic seals 8 may secured to the end wall 14 using the adhesive 64 located at the adhesive-bearing location 68.

If the adhesive 64 at the adhesive-bearing location 68 is in the form of an adhesive strip, one side may already be adhered to the acoustic seals 8, and the seals may be attached to the end wall 14 by removing a peel-off backing (if present) from the other side of the adhesive strip prior to pressing the seals onto the end wall. Alternatively, if an adhesive strip is not already attached to the acoustic seals 8 at the adhesive-bearing location 68, a pair of adhesive strips could first be applied to either the seals or the end wall 14, and the end wall 14 could then be pressed onto the seals.

Once the end wall 14 is mounted to the acoustic seals 8, the end stud 12 may be attached to the top and bottom plates of the architectural separation 4. The drywall pieces that form the side walls 16 and 18 of the architectural separation 4 may then be installed onto the end stud 12 and the other framing elements (not shown) used to support the drywall.

Once the architectural assembly 2 is complete, the flanking path 10 will be acoustically blocked by the acoustic seals 8, improving STC performance in comparison to an untreated joint. Cosmetically, the only visible component of the acoustic seals 8 will be the angled surface 62 that may be curved to appear as a molding.

Accordingly, an acoustic seal has been disclosed for sealing a sound flanking path between an interior architectural separation and a mullion, together with an architectural assembly that incorporates the acoustic seal and an architectural assembly construction method. While various embodiments of the invention have been described, it should be apparent that many variations and alternative embodiments could be implemented in accordance with applicant's invention. For example, although the architectural assembly 2 is shown as using a pair of the acoustic seals 8, it would be possible to integrate both seals into a single acoustic seal in which the base rail free edges 50 of each seal are merged so as to eliminate such edges. It is understood, therefore, that the invention is not to be in any way limited except in accordance with the spirit of the appended claims and their equivalents.

What is claimed is:

1. An acoustic seal for sealing a sound flanking path between an interior architectural separation and a mullion, comprising:

a seal body configured as an elongated rail having a base rail portion and a side rail portion;

said base rail portion having two substantially planar and mutually parallel base rail sides, one of said base rail sides defining a first seal surface arranged to engage a first interior side of said mullion, the other of said base rail sides defining a second seal surface arranged to engage an end wall of said interior architectural separation;

said side rail portion having two substantially planar and mutually perpendicular side rail sides, one of said side rail sides defining a third seal surface that is substantially non-parallel with respect to said first seal surface and arranged to engage a second interior side of said mullion, the other of said side rail sides defining a fourth seal surface that is in substantially coplanar relationship with said second seal surface and arranged to engage said end wall of said interior architectural separation;

said first seal surface and said third seal surface forming an inside seal corner that is arranged to envelop an outside corner of said mullion defined by said first and second interior sides of said mullion; and adhesive arranged to attach said seal to said first interior side of said mullion and to said end wall of said interior architectural separation, said adhesive being disposed solely at laterally offset locations on said seal so that relative movement between said interior architectural separation and said mullion that results in an increase in spacing between said end wall of said interior architectural separation and said first interior side of said mullion will induce only laterally offset applied loads on said seal.

2. The acoustic seal of claim 1, wherein said adhesive is disposed on respective first and second adhesive-bearing portions of said first seal surface and said fourth seal surface, said first and second adhesive-bearing portions being laterally offset from each another.

3. The acoustic seal of claim 2, wherein said elongated rail includes a first channel formed in said first seal surface between said first adhesive-bearing portion and said interior corner, and a second channel formed in said second seal surface proximate to a point of intersection of said second seal surface and said fourth seal surface, said first and second channels being configured to facilitate offset flexing of said base rail portion and said side rail portion in response to relative movement between said interior architectural separation and said mullion that results in changes in spacing between said end wall of said interior architectural separation and said first interior side of said mullion.

4. The acoustic seal of claim 1, wherein said base rail portion includes a base rail free edge that defines a first longitudinal edge of said elongated rail, said first and second seal surfaces extending to said first base rail free edge.

5. The acoustic seal of claim 4, wherein said side rail portion includes a first side rail free edge that defines a second longitudinal edge of said elongated rail, said fourth seal surface extending to said first side rail edge.

6. The acoustic seal of claim 5, wherein said third seal surface extends from said interior seal corner to a second side rail free edge that defines a longitudinal edge of a flange portion of said elongated rail.

7. The acoustic seal of claim 6, wherein said side rail portion comprises a curved surface extending between said first and second side rail free edges such that said side rail portion functions as an architectural molding.

8. An architectural assembly, comprising:

an interior architectural separation;

a mullion;

an acoustic seal sealing a sound flanking path between said interior architectural separation and said mullion, said acoustic seal comprising:

a seal body configured as an elongated rail having a base rail portion and a side rail portion;

said base rail portion having two substantially planar and mutually parallel base rail sides, one of said base rail sides defining a first seal surface that engages a first interior side of said mullion, the other of said base rail sides defining a second seal surface that engages an end wall of said interior architectural separation;

said side rail portion having two substantially planar and mutually perpendicular side rail sides, one of said side rail sides defining a third seal surface that is substantially non-parallel with respect to said first seal surface and engages a second interior side of said mullion, the other of said side rail sides defining a fourth seal surface that is in substantially coplanar relationship with said second seal surface and engages said end wall of said interior architectural separation;

said first seal surface and said third seal surface forming an inside seal corner that is arranged to envelop an outside corner of said mullion defined by said first and second interior sides of said mullion; and adhesive attaching said seal to said first interior side of said mullion and to said end wall of said interior architectural separation, said adhesive being disposed solely at laterally offset locations on said seal so that relative movement between said interior architectural separation and said mullion that results in an increase in spacing between said end wall of said interior architectural separation and said first interior side of said mullion will induce only laterally offset applied loads on said seal.

9. The architectural assembly of claim 8, wherein said adhesive is disposed on respective first and second adhesive-bearing portions of said first seal surface and said fourth seal surface, said first and second adhesive-bearing portions being laterally offset from each another.

10. The architectural assembly of claim 9, wherein said elongated rail includes a first channel formed in said first seal surface between said first adhesive-bearing portion and said interior corner, and a second channel formed in said second seal surface proximate to a point of intersection of said second seal surface and said fourth seal surface, said first and second channels being configured to facilitate offset flexing of said base rail portion and said side rail portion in response to relative movement between said interior architectural separation and said mullion that results in changes in spacing between said end wall of said interior architectural separation and said first interior side of said mullion.

11. The architectural assembly of claim 8, wherein said base rail portion includes a base rail free edge that defines a first longitudinal edge of said elongated rail, said first and second seal surfaces extending to said first base rail free edge.

12. The architectural assembly of claim 11, wherein said side rail portion includes a first side rail free edge that defines a second longitudinal edge of said elongated rail, said fourth seal surface extending to said first side rail edge.

13. The architectural assembly of claim 12, wherein said third seal surface extends from said interior seal corner to a second side rail free edge that defines a longitudinal edge of a flange portion of said elongated rail.

14. The architectural assembly of claim 13, wherein said side rail portion comprises a curved surface extending between said first and second side rail free edges such that said side rail portion functions as an architectural molding.

15. An architectural assembly construction method, comprising:

providing an acoustic seal for sealing a sound flanking path between an interior architectural separation and a mullion, said acoustic seal comprising:

a seal body configured as an elongated rail having a base rail portion and a side rail portion;

said base rail portion having two substantially planar and mutually parallel base rail sides, one of said base rail sides defining a first seal surface arranged to engage a first interior side of said mullion, the other of said base rail sides defining a second seal surface arranged to engage an end wall of said interior architectural separation;

said side rail portion having two substantially planar and mutually perpendicular side rail sides, one of said side rail sides defining a third seal surface that is substantially non-parallel with respect to said first seal surface and arranged to engage a second interior side of said mullion, the other of said side rail sides defining a fourth seal surface that is in substantially coplanar relationship with said second seal surface and arranged to engage said end wall of said interior architectural separation;

said first seal surface and said third seal surface forming an inside seal corner that is arranged to envelop an outside corner of said mullion defined by said first and second interior sides of said mullion; and adhesive arranged to attach said seal to said first interior side of said mullion and to said end wall of said interior architectural separation, said adhesive being disposed solely at laterally offset locations on said seal so that relative movement between said interior architectural separation and said mullion that results in an increase in spacing between said end wall of said interior architectural separation and said first interior side of said mullion will induce only laterally offset applied loads on said seal;

mounting said acoustic seal on a mullion with said first sealing surface facing the first interior side of said mullion and said third sealing surface facing a second interior side of said mullion;

mounting an end wall of an interior architectural separation to said acoustic seal with said end wall thereof facing said first and fourth sealing surfaces of said acoustic seal.

16. The architectural assembly construction method of claim 15, wherein said adhesive is disposed on respective first and second adhesive-bearing portions of said first seal surface and said fourth seal surface, said first and second adhesive-bearing portions being laterally offset from each another.

17. The architectural assembly construction method of claim 16, wherein said elongated rail includes a first channel formed in said first seal surface between said first adhesive-bearing and said interior corner, and a second channel formed in said second seal surface proximate to a point of intersection of said second seal surface and said fourth seal surface, said first and second channels being configured to facilitate offset flexing of said base rail portion and said side rail portion in response to relative movement between said interior architectural separation and said mullion that results in changes in spacing between said end wall of said interior architectural separation and said first interior side of said mullion.

18. The architectural assembly construction method of claim 15, wherein said base rail portion includes a base rail free edge that defines a first longitudinal edge of said elongated rail, said first and second seal surfaces extending to said first base rail free edge.

19. The architectural assembly construction method of claim 18, wherein said side rail portion includes a first side rail free edge that defines a second longitudinal edge of said elongated rail, said fourth seal surface extending to said first side rail edge.

20. The architectural assembly construction method of claim 19, wherein said third seal surface extends from said interior seal corner to a second side rail free edge that defines a longitudinal edge of a flange portion of said elongated rail.

21. The architectural assembly construction method of claim 20, wherein said side rail portion comprises a curved surface extending between said first and second side rail free edges such that said side rail portion functions as an architectural molding.

* * * * *